US005364702A

United States Patent [19]

Idei et al.

[11] Patent Number: 5,364,702

[45] Date of Patent: Nov. 15, 1994

[54] INK-JET RECORDING MEDIUM

[75] Inventors: Kouji Idei; Hideaki Senoo, both of Tokyo, Japan

[73] Assignee: Mitsubishi Paper Mills Limited, Tokyo, Japan

[21] Appl. No.: 143,379

[22] Filed: Oct. 29, 1993

Related U.S. Application Data

[63] Continuation of Ser. No. 543,914, Jun. 26, 1990, abandoned.

[30] Foreign Application Priority Data

Jul. 12, 1989 [JP] Japan ..... 1-181007

[51] Int. Cl.[5] ..... B41M 5/00

[52] U.S. Cl. ..... 428/423.1; 428/195; 428/211; 428/331; 428/478.2; 428/480; 428/500; 428/520; 428/521; 428/532; 428/537.5

[58] Field of Search ..... 428/195, 211, 331, 423.1, 428/478.2, 480, 500, 520, 521, 532, 537.5

[56] References Cited

U.S. PATENT DOCUMENTS

| | | | |
|---|---|---|---|
| 4,756,950 | 7/1988 | Matsushita et al. | 428/195 |
| 4,770,934 | 9/1988 | Yamasaki et al. | 428/331 |
| 4,900,620 | 2/1990 | Tokita et al. | 428/195 |
| 4,957,553 | 9/1990 | Koike et al. | 106/22 |
| 5,059,983 | 10/1991 | Higuma et al. | 428/195 |

FOREIGN PATENT DOCUMENTS

| | | |
|---|---|---|
| 355752 | 2/1990 | European Pat. Off. . |
| 52-53012 | 4/1977 | Japan . |
| 53-49113 | 5/1978 | Japan . |
| 55-5830 | 1/1980 | Japan . |
| 55-11829 | 1/1980 | Japan . |
| 55-51583 | 4/1980 | Japan . |
| 56-19793 | 2/1981 | Japan . |
| 58-65097 | 4/1983 | Japan . |
| 58-190956 | 11/1983 | Japan . |
| 60-171190 | 9/1985 | Japan . |
| 60-198285 | 10/1985 | Japan . |
| 61-132376 | 6/1986 | Japan . |
| 61-179781 | 8/1986 | Japan . |
| 60-209190 | 9/1986 | Japan . |
| 61-237680 | 10/1986 | Japan . |
| 61-255896 | 11/1986 | Japan . |
| 62-21579 | 1/1987 | Japan . |
| 62-144986 | 6/1987 | Japan . |
| 63-139964 | 6/1988 | Japan . |
| 2122230 | 1/1984 | United Kingdom . |

OTHER PUBLICATIONS

Brochure of "Surfynol 400" series of Air Products Corp., Pennsylvania, published in Jun. 1976.

Brochure: "Surfynol 104", *Air Products Corp.*, (1976).

Brochure: "Applications of Nonionic Surface Active Agent of Surfynol", *Air Products Corp.*, (1976).

*Primary Examiner*—Pamela R. Schwartz

*Attorney, Agent, or Firm*—Armstrong, Westerman, Hattori, McLeland & Naughton

[57] ABSTRACT

The invention provides an ink-jet recording medium for forming record images using an aqueous ink containing at least one water-soluble dye selected from direct dye, acidic dye, basic dye, reactive dye and dye for food, said medium containing at least one of acetylene glycol, ethylene oxide addition product of acetylene glycol and acetylene alcohol which have one triple bond in the molecule. This ink-jet recording medium provides images or letters of high density and besides is excellent in ink absorbency.

15 Claims, No Drawings

INK-JET RECORDING MEDIUM

This application is a continuation of application Ser. No. 07/543,914 filed Jun. 26, 1990, now abandoned.

The present invention relates to a recording medium on which recording is carried out using an ink and in particular to an ink-jet recording medium which can afford high density of images or letters recorded thereon and has excellent ink absorbency.

An ink-jet recording system records images or letters by squirting droplets of ink by various means to allow them to adhere to a recording medium such as paper. Because of its characteristics such as low noise, high-speed recording, ease of multicolor recording, great flexibility of record pattern and unnecessity of development and fixation, the ink-jet recording system is becoming increasingly popular in various fields as recording system for various figures including kanji (Chinese characters), color images and the like. Furthermore, images formed by multicolor ink-jet recording are by no means inferior to prints obtained by multicolor printing according to plate-making system or by a color photography system. Therefore, multicolor ink-jet recording system is now widely applied to the field of full-color image recording when many prints are not required because this system is less expensive than recording by photographic technique.

With reference to recording medium used in this ink-jet recording system, apparatus and composition of ink have been studied in order that woodfree paper or coated paper which is used for normal printing or writing can be used. However, recording medium has also be required to have characteristics of high level for improvement of performance of ink-jet recording apparatus or extension of uses, namely, speeding-up and increase in detail of apparatus and development of full color recording. That is, a recording medium must satisfy the following requirements: ink dots have high density and clear and bright color tone; it absorbs ink fast and even if an ink dot overlaps a previously applied dot, ink does not flow or blot; ink dots do not diffuse so as not to be enlarged more than needed; and the perimeter of dots has smooth and distinct line.

In order to solve these problems, some proposals have been made. For example, an ink-jet recording paper comprising a base paper of low size content which is wetted with a coating composition for surface processing is disclosed in Japanese Patent Kokai (Laid-Open) No. 52-53012 and an ink-jet recording paper comprising an urea-formaldehyde resin powder-internally added sheet which is impregnated with a water-soluble polymer is disclosed in Japanese Patent Kokai (Laid-Open) No. 53-49113. Furthermore, an ink-jet recording paper which comprises a support and an ink-absorbing coating layer provided on the surface of the support is disclosed in Japanese Patent Kokai (Laid-Open) No. 55-5830, use of amorphous silica powder as a pigment in coating layer is disclosed in Japanese Patent Kokai (Laid-Open) No. 55-51583, and a paper coated with a layer of two-layer structure different in ink absorbing rate is disclosed in Japanese Patent Kokai (Laid-Open) No. 55-11829.

Furthermore, it is proposed in Japanese Patent Kokai (Laid-Open) No. 60-171190 that ink absorbency of ink-jet recording paper comprising a support which is coated with an aqueous coating composition comprising inorganic pigment and a binder to which various surface active agents are added can be increased by using a specific nonionic surface active agent having an HLB of 4–10 in a normally employed aqueous coating composition in an amount of 1–10% by weight based on the weight of the solid content of the coating composition.

Furthermore, Japanese Patent Kokai (Laid-Open) No. 60-198285 discloses that good solid image with no omitted portion can be recorded by using a water-impermeable material which does not absorb ink as a support and adding anionic surface active agent or nonionic surface active agent to a coat, whereby wettability of surface of recording medium is improved, spreading of ink in the horizontal direction is increased and diameter of picture element of recorded image is increased.

Moreover, Japanese Patent Kokai (Laid-Open) No. 61-179781 discloses that a surface active agent is contained in a material on which recording is made, Japanese Patent Kokai (Laid-Open) No. 61-209190 discloses an ink-jet recording sheet which contains polyethylene oxide in ink-receiving layer, Japanese Patent Kokai (Laid-Open) No. 61-132376 discloses a recording sheet mainly for overhead projector (hereinafter referred to as "OHP") in which water-soluble polymer compound and surface active agent are used in combination. Furthermore, Japanese Patent Kokai (Laid-Open) No. 61-237680 discloses an OHP sheet which contains a high-boiling point solvent such as low molecular weight polyethylene glycol or polypropylene glycol and Japanese Patent Kokai (Laid-Open) No. 62-144986 discloses a recording sheet mainly for OHP which contains a nonionic surface active agent having an HLB of 3–12 in an amount of 0.1% by weight or less. Moreover, Japanese Patent Kokai (Laid-Open) No. 62-21579 discloses a sheet containing 0.1–5% by weight of an alkyl imidazoline type ampholytic surface active agent.

In ink-jet recording method, many proposals have been made on recording medium in an attempt to solve the various problems as mentioned above. Accordingly, the quality of record image has also been highly improved.

Quality of record image obtained by ink-jet recording method has close relations with three of performance of recording apparatus, properties of ink and performance of recording medium.

The recording apparatus has deep relation with ink and must perform stable formation of ink droplets for obtaining record of high quality. Especially, inferior formation of ink droplets due to drying of ink in nozzle holes of recording apparatus results in critical defect in quality of record image and so drying of ink in nozzle holes must be prevented. For this purpose, there have been proposed various methods such as improvement in shape of nozzle holes and capping of nozzle hole portion while recording is not conducted. Besides, it has also been proposed to retard or inhibit drying of ink per se by adding wetting agent to ink. However, for prevention of clogging of nozzle holes or owing to low solubility of dye, the aqueous ink is low in concentration of dye, which is mostly only about 1–5% and hence, recording medium is required to have a high ink absorbency. Especially, for multicolor recording, ink on the recording medium must be rapidly dried.

On the other hand, in order to assure high dot density and image density and contrast, colorfulness and clarity based on feature of dye, ideally it is necessary to fix ink dye on the surface of recording medium and make solvent of the ink be absorbed in coating layer provided thereunder or support.

Non-coated type ink-jet recording medium per se must have absorbency and hence must be no-size paper or low-size paper which contains sizing agent in a slight amount. However, when such recording medium is subjected to recording with aqueous ink, the medium show good ink absorbency, but colorfulness and contrast of images, density of dots and density of images are low and shape of dot becomes inferior, namely, becomes rugged in the form of feathers of bird called "feathering" and perimeter of dot becomes dim and in addition, ink penetrates deeply into base paper and passes therethrough to the back side.

On the other hand, in case of coated type ink-jet recording media, those which comprises no-size paper or low-size paper as a support and a coating layer provided thereon are good in absorbency and are improved over non-coated type ink-jet recording media in colorfulness, distinctness, feathering and penetration of ink to the back side. However, in case of full color recording media which are subjected to high-density printing, when density of jetted dots of ink droplets is increased, amount of ink received in unit area increases and consequently, dye in the ink does not remain on the surface of recording media and deeply penetrates into the support and finally exudes to the back side and as a result the above characteristics are considerably damaged. Moreover, in the case of recording media comprising a support which absorbs no aqueous ink or is low in absorbency such as high size paper, polyethylene terephthalate film, or synthetic paper and a coating layer provided thereon, the support per se hardly absorbs ink solvent and so dye is retained on the surface of recording madia and therefore, there can be easily obtained images superior, in dot density, image density, colorfulness, and distinctness, and showing no feathering and no penetration of ink. However, the recording media area is inferior in absorbency of ink and especially low in ink absorbing rate in multi-overprint ink-jet recording and absorption volume decreases. In order to increase absorption volume, when coating amount is increased, adhesion of coating layer are inferior and removal of powder out of the layer increases and thus these recording media are not suitable for practical use.

As mentioned above, absorbency appears to be enhanced by including various surface active agents in coating layer. It is considered that film-formability of binder in coating layer is reduced and consequently, pore volume in the coating layer increases or surface tension lowers, whereby ink absorbency is improved. Known nonionic surface active agents and anionic surface active agents have the action to enlarge dot diameter of recorded image.

As mentioned in the above explanation on prior art, an ink-jet recording medium must satisfy the following requirements.

(1) Ink dot density and image density are high.
(2) Colorfulness and vividness of image are good.
(3) Shape of ink dots is superior.
(4) Ink absorbency is high.
(5) Recorded image has high water resistance and light resistance.
(6) For coated type recording medium, adhesion of coating layer is high and removal of powder out of the layer is less.

The object of the present invention is to provide an ink-jet recording medium with no significant change in diameter of ink dot and with high absorbency (absorbing rate, absorption volume) irrespective of non-coated type or coated type recording medium and irrespective of sizing degree of support by containing at least one of acetylene glycol, ethylene oxide addition product of acetylene glycol and acetylene alcohol.

Acetylene glycol or acetylene alcohol used in the present invention has been used in other fields to impart functions different from that aimed at in the present invention. For example, in Japanese Patent Kokai (Laid-Open) No. 56-19793, a heat-sensitive sheet has been proposed which is inhibited from fogging in background by containing acetylene glycol or acetylene alcohol in an amount of 0.05–20% by weight based on the weight of leuco compound. In Japanese Patent Kokai (Laid-Open) No. 61-255896, it has been proposed to conduct gradational recording by containing gallic acid or the like and acetylene glycol in ink layer of heat melting transfer recording sheet (called doner sheet) having heat melting ink layer.

According to the present invention, conspicuously advantageous effects utterly different from the above two examples in field, construction and function can be obtained and completely novel construction and unexpectable effects different from those obtained by the addition of known general nonionic surface active agents have been found. As a result, the present invention has been accomplished.

The present invention provides an ink-jet recording medium on which record images are formed using an aqueous ink containing at least one water-soluble dye selected from direct dye, acidic dye, basic dye, reactive dye and dye for food, wherein said recording medium contains at least one compound selected from the group consisting of acetylene glycol, ethylene oxide addition product of acetylene glycol and acetylene alcohol which have one triple bond in its molecule.

Preferably, the recording medium comprises a support and, provided thereon, at least one ink-receiving layer wherein the ink-receiving layer contains an inorganic pigment, a water-soluble polymer binder, and a cationic oligomer or polymer. The inorganic pigment is preferably synthetic particulate silica.

The "low size paper" used here means a paper having a Stöckight sizing degree of 4 seconds or less based on the basis weight of 60 g/m$^2$, the "medium size paper" means a paper having a Stöckight sizing degree of 5–20 seconds based on the basis weight of 60 g/m$^2$ and the "high size paper" means a paper having a Stöckight sizing degree of 21 seconds or more based on the basis weight of 60 g/m$^2$. According to the present invention, high absorbency can be obtained irrespective of low size paper, medium size paper or high size paper and non-coated type or coated-type ink-jet recording medium. Especially, even when high size paper is used, an ink-jet recording medium of high absorbency free from the defects such as penetration of ink to the back side can be obtained.

These acetylene glycol, ethylene oxide addition product of acetylene glycol and acetylene alcohol which have one triple bond in its molecule are used preferably in an amount of 0.1–2 parts by weight every 100 parts by weight of adhesive, but when it is desired to increase absorbency with decrease of diameter of ink dots, the amount can be further increased up to 10 parts by weight every 100 parts by weight of adhesive, exceeding 2 parts by weight. If the compound is added in an amount of more than 10 parts by weight, film-formability of adhesive decreases.

Furthermore, the above compound is contained preferably in a proportion of 5–500 mg/m$^2$ in recording medium, but the proportion is not critical.

For making the recording medium of the present invention, there is provided a method according to which a slurry prepared by defiberizing pulp is made into paper by a paper-making machine, during which a size press solution containing at least one of acetylene glycol, ethylene oxide addition product of acetylene glycol and acetylene alcohol is impregnated or coated by a size press and a method according to which at least one of acetylene glycol, ethylene oxide addition product of acetylene glycol and acetylene alcohol is contained in coating liquid and this coating liquid is coated by a roll coater such as gate roll coater or a normal coating apparatus such as air knife coater, blade coater or spray coater and is dried to provide an ink-receiving layer. In this case, a filler, pigment, adhesive and other additives which are generally employed may be used in combination.

The filler and pigment used in the present invention include, for example, inorganic white pigments such as light calcium carbonate, heavy calcium carbonate, kaolin, talc, calcium sulfate, barium sulfate, titanium oxide, zinc oxide, zinc sulfide, zinc carbonate, satin white, aluminium silicate, diatomaceous earth, calcium silicate, magnesium silicate, synthetic amorphous silica, aluminium hydroxide, alumina, and lithopone; and organic pigments such as styrene type plastic pigments, acrylic plastic pigments, microcapsules, and urea resin pigments.

Adhesives used in the present invention include aqueous adhesives, for example, polyvinyl alcohol; oxidized starch; etherified starch; cellulose derivatives such as carboxymethyl cellulose and hydroxyethyl cellulose; casein; gelatin; soybean protein; silanol-modified polyvinyl alcohol; maleic anhydride resin; conjugated diene copolymer latexes such as normal styrene-butadiene copolymer and methyl methacrylate-butadiene copolymer; acrylic polymer latexes such as homopolymers or copolymers of acrylic acid esters and methacrylic acid esters; vinyl polymer latexes such as ethylene-vinyl acetate copolymer; functional group-modified polymer latexes comprising the above various polymers which are modified with monomers containing functional group such as carboxyl group; and aqueous adhesives composed of thermosetting synthetic resins such as melamine resin and urea resin; and synthetic resin adhesives such as polymethyl methacrylate, polyurethane resin, unsaturated polyester resin, vinyl chloride-vinyl acetate copolymer, polyvinyl butyral, and alkyl resin. These may be used singly or in combination of two or more.

In the present invention, cationic resin may also be used in combination. As the cationic resins, any of known monomers, oligomers, or polymers which when dissolved in water, dissociate to show cationic property can be used. Preferred are oligomers or polymers having a tertiary or quaternary ammonium group.

Other additives may be used and examples thereof include pigment dispersant, thickening agent, flowability improver, anti-foaming agent, foaming suppressor, releasing agent, foaming agent, penetrating agent, color dye, color pigment, fluorescent brightening agent, ultraviolet absorber, antioxidant, preservative, antifungal agent, waterproofing agent, wet strength reinforcing agent, and dry strength reinforcing agent.

Papers used as the support may be those which contain no sizing agent or those which have been subjected to proper sizing and have no special limitation, but preferred are those which have a Stöckight sizing degree of about 0–40 seconds and which may or may not contain filler. Papers subjected to proper sizing are those which are sized with a neutral sizing agent and have a pH of 5.2–10.5 when extracted with cold water and which may or may not contain filler. Furthermore, the papers may be so-called acidic papers sized with rosin sizing agent, but those which contain neutral sizing agent and filler are preferred as base papers for coated type recording medium.

The neutral sizing agents include, for example, cellulose-reactive type sizing agents such as higher organic ketene dimers (alkyl ketene dimers) and substituted cyclic dicarboxylic acid anhydrides; cationic self-fixing type sizing agents such as epoxidized higher fatty acid amides, cationized styrenemaleic anhydride copolymer, and cationized petroleum resin; and so-called external sizing agents which develop sizing property by application to the surface of paper by a size press apparatus, gate roll coater, etc. such as styrene-acrylic acid copolymer, styrene-maleic acid copolymer, $\alpha$-olefin-maleic anhydride copolymer, and petroleum resin. Preferred are those selected from alkyl ketene dimers and substituted cyclic dicarboxylic acid anhydride, especially preferred are alkyl ketene dimers. A support of 0–40 seconds in Stöckight sizing degree can be produced by using one or more of these sizing agents. Even if Stöckight sizing degree is more than 40 seconds, the effect of the present invention is not affected so much, but increase of sizing degree too much is meaningless.

When fillers are used, there may be internally added those which are ordinarily used in neutral paper-making system, such as talc, clay, heavy calcium carbonate, light calcium carbonate, calcined kaolin, aluminium oxide, aluminium hydroxide, titanium oxide, aluminium silicate, synthetic amorphous silica, and urea-formaldehyde resin. Preferred are alkaline fillers such as heavy calcium carbonate, light calcium carbonate, and aluminium hydroxide. Addition amount of these fillers is preferably 5'30 parts by weight every 100 parts by weight of pulp.

A sheet just obtained by coating a layer on a support can be used, as it is, as recording sheet in the present invention, but may further be imparted with surface smoothness by heating the sheet by super calender, gloss calender and the like and/or passing the sheet through pressure roll nip. In this case, excess processing by super calender causes reduction in absorbency of ink due to voids between particles produced and so degree of processing should be limited in some cases.

The recording medium of the present invention may be used not only as ink-jet recording medium, but also as any recording medium which uses ink which is liquid at the time of recording. The latter recording medium includes, for example, a heat melting type transfer recording medium which is an ink sheet which comprises a thin support such as resin film, high-density paper or synthetic paper on which is melt coated a heat melting ink which is solid at room temperature and which is mainly composed of waxes, resins, dyes and pigments and which is used as a doner sheet and heated from back side carrying ink to melt and transfer the ink; an ink-jet recording medium on which record is made by squirting with droplets of the above-mentioned heat melting ink which is solid at room temperature: an ink-jet recording medium on which record is made using an ink prepared by dissolving an oil soluble dye in a solvent; and photosensitive pressure-sensitive doner sheet which has microcapsules containing a photopolymerizable monomer and a colorless or colored dye or pigment.

It is common to these recording media that ink is in the form of liquid at the time of recording. The liquid ink penetrates or diffuses into ink-receiving layer in the depth direction thereof or in horizontal direction during the period of hardening, solidifying and fixing. Therefore, recording media require absorbency for respective recording systems. Accordingly, the recording medium of the present invention can be used as any of the above recording media without any problems.

The present invention will now be described in detail in the following examples, it being understood that the invention is not limited to these examples. All parts are by weight.

Measurement of suitability for ink-jet recording was carried out by the following method.

Ink absorbing rate was evaluated in the following manner: Immediately after formation of solid red print (magenta+yellow) using an ink-jet printer (IO-720 manufactured by Sharp Corporation or A-1210 manufactured by Canon, Inc.) (after about 1 second), the sheet was moved forwards and was allowed to contact with paper press roll or fingers and it was observed whether stain occurred or not. Occurrence of no stain means high ink absorbing rate and this is good.

Diameter of ink dots was measured by printing dots with black ink using ink-jet printer A-1210 manufactured by Canon, Inc. and calculating diameter of the dots in terms of corresponding circles by image analyzer.

EXAMPLE 1

To a pulp slurry comprising 80 parts of hardwood kraft pulp of 370 ml in Canadian standard freeness and 20 parts of softwood kraft pulp of 400 ml in Canadian standard freeness were added 20 parts of talc and 0.5 part of cationized starch (CATOF manufactured by Oji National Co., Ltd.) and a paper of 60 g/m$^2$ in basis weight was made from this pulp slurry by a wire paper machine, during which a 2% size press solution containing 1 part of acetylene glycol represented by the following formula (I) (Surfynol 104 manufactured by Nisshin Kagaku Kogyo Co., Ltd.) in polyvinyl alcohol (PVA 117 manufactured by Kuraray Co., Ltd.) was applied in a proportion of 3 g/m$^2$ (in terms of solid content) by a size press, and the paper was dried and then, was finished by machine calendering. This was referred to the recording sheet of Example 1.

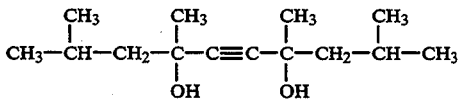

(I)

COMPARATIVE EXAMPLE 1

A recording sheet was obtained in the same manner as in Example 1 except that polyvinyl alcohol (PVA 117) alone was used as the size press solution.

COMPARATIVE EXAMPLE 2

On a wood free paper having a Stöckight sizing degree of 10 seconds and a basis weight of 60 g/m$^2$ as a base paper was coated a coating liquid of 15% in concentration comprising 100 parts of synthetic amorphous silica (Finesil X-37B manufactured by Tokuyama Soda Co., Ltd.), 80 parts of polyvinyl alcohol (PVA 117), and 20 parts of cationic resin (Polyfix 601 manufactured by Showa Kobunshi Co., Ltd.) at a coating amount (solid content) of 10 g/m$^2$ by an air knife coater, followed by subjecting to super calender finishing to obtain a recording sheet of Comparative Example 2.

EXAMPLE 2

A recording sheet was obtained in the same manner as in Comparative Example 2 except that 0.8 part of acetylene glycol (Surfynol 104) was added to the coating liquid.

EXAMPLE 3

A recording sheet was obtained in the same manner as in Comparative Example 2 except that 0.8 part of acetylene glycol (Surfynol 82 manufactured by Nisshin Kagaku Co., Ltd.) represented by the formula (II) was added to the coating liquid.

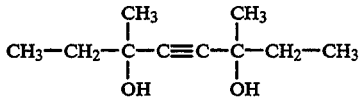

(II)

EXAMPLE 4

A recording sheet was obtained in the same manner as in Comparative Example 2 except that 0.8 part of an ethylene oxide addition product of acetylene glycol (Surfynol 465 manufactured by Nisshin Kagaku Kogyo Co., Ltd.) represented by the formula (III) was added to the coating liquid.

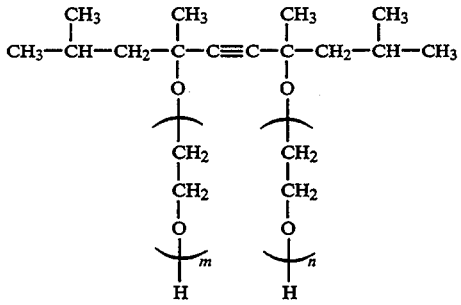

(III)

(m + n = 10)

EXAMPLE 5

A recording sheet was obtained in the same manner as in Comparative Example 2 except that 0.8 part of acetylene alcohol (Surfynol 61 manufactured by Nisshin Kagaku Kogy Co., Ltd.) represented by the formula (IV) was added to the coating liquid.

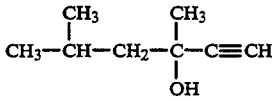

(IV)

EXAMPLE 6

A recording sheet was obtained in the same manner as in Comparative Example 2 except that 0.1 part of acetylene glycol (Surfynol TG: a mixture of the above Surfynol 104, polyoxyethylenealkylphenyl ether and ethylene glycol manufactured by Nisshin Kagaku Kogyo Co., Ltd.) was added to the coating liquid.

EXAMPLE 7

A recording sheet was obtained in the same manner as in Comparative Example 2 except that 0.4 part of acetylene glycol (Surfynol TG) was added to the coating liquid.

EXAMPLE 8

A recording sheet was obtained in the same manner as in Comparative Example 2 except that 0.8 part of acetylene glycol (Surfynol TG) was added to the coating liquid.

EXAMPLE 9

A recording sheet was obtained in the same manner as in Comparative Example 2 except that 1.6 part of acetylene glycol (Surfynol TG) was added to the coating liquid.

EXAMPLE 10

The coating liquid of Example 3 was coated on the coated paper of Example 2 (before subjected to super calendering finishing) at a coating amount of 5 g/m$^2$ (solid content), followed by subjecting it to super calendering finishing to obtain a recording sheet of Example 10.

COMPARATIVE EXAMPLE 3

A recording sheet was obtained in the same manner as in Comparative Example 2 except that 0.8 part of a nonionic surface active agent (TWEEN 21: ethylene oxide addition product of sorbitan resin acid monoester manufactured by Kao-Atlas Ltd.) was added to the coating liquid.

The recording sheets obtained above were evaluated on suitability to ink-jet recording and the results are shown in the table.

TABLE

| | Example 1 | Example 2 | Example 3 | Example 4 | Example 5 | Example 6 | Example 7 |
|---|---|---|---|---|---|---|---|
| Construction of coating layer | By size press | One layer | One layer | One layer | One layer | One layer | One layer |
| Compounds (tradename) | Surfynol 104 | Surfynol 104 | Surfynol 82 | Surfynol 465 | Surfynol 61 | Surfynol TG | Surfynol TG |
| Addition amount (part by weight based on adhesive) | 1.0 part | 1.0 part | 1.0 part | 1.0 part | 1.0 part | 0.125 part | 0.5 part |
| Ink absorbing rate *1 | ○ | ◎ | ◎ | ◎ | ◎ | ○ | ◎ |
| Diameter of ink dot (μm) | 365 | 305 | 310 | 295 | 315 | 315 | 305 |

| | Example 8 | Example 9 | Example 10 | Comparative Example 1 | Comparative Example 2 | Comparative Example 3 |
|---|---|---|---|---|---|---|
| Construction of coating layer | One layer | One layer | Two layers | By size press | One layer | One layer |
| Compounds (tradename) | Surfynol TG | Surfynol TG | Surfynol 104, 82 | — | — | TWEEN 21 |
| Addition amount (part by weight based on adhesive) | 1.0 part | 2.0 parts | 1.0 part | — | — | 1.0 part |
| Ink absorbing rate *1 | ◎ | ◎ | ◎ | x | Δ | x |
| Diameter of ink dot (μm) | 300 | 290 | 295 | 380 | 320 | 350 |

*1 ◎: good
○: Acceptable for practical use.
Δ: Not good for practical use.
x: Bad.

As is clear from Example 1, non-coated type ink-jet recording medium of high absorbency was obtained.

Furthermore, as is clear from Examples 2–5, coated type ink-jet recording media of high absorbency were obtained without causing excess reduction in ink dot diameter by using any of acetylene glycol, ethylene oxide addition product of acetylene glycol and acetylene alcohol.

Moreover, as is clear from Examples 6–9, coated type ink-jet recording media of high absorbency were obtained without causing excess reduction in ink dot diameter even when addition amount was changed.

Further, as is clear from Example 10, coated type ink-jet recording medium of high absorbency was obtained without causing reduction in ink dot diameter even when two coating layers were provided.

According to the present invention, ink-jet recording media of high absorbency can be obtained by containing therein at least one of acetylene glycol, ethylene oxide addition product of acetylene glycol and acetylene alcohol.

What is claimed is:

1. An ink-jet recording medium for forming record images, said medium comprising an ink-receiving layer coated upon a support, said ink-receiving layer containing (1) at least one compound having one triple bond in the molecule and selected from the group consisting of acetylene glycol, ethylene oxide addition product of acetylene glycol and acetylene alcohol, (2) an adhesive and (3) an inorganic pigment wherein said support contains from 5 to 30 parts by weight of filler per 100 parts by weight of support and said support has a Stöckight sizing degree of 5 seconds or more;

said ink-jet recording medium being adapted to receive an aqueous ink containing at least one water-soluble dye selected from the group consisting of direct dye, acidic dye, basic dye, reactive dye and dye for food;

and wherein said adhesive is at least one member selected from the group consisting of polyvinyl alcohol, oxidized starch, etherified starch, carboxymethyl cellulose, hydroxyethyl cellulose, casein, gelatin, soybean protein, silanol-modified polyvinyl alcohol, maleic anhydride resin, conjugated diene copolymer, acrylic polymer, polyurethane resin, unsaturated polyester resin, vinyl chlorine resin-vinyl acetate copolymer, polyvinyl butyral, alkyl resin, melamine resin and urea resin.

2. An ink-jet recording medium according to claim 1, wherein the ink-receiving layer further contains a cationic oligomer or polymer.

3. An ink-jet recording medium according to claim 2, wherein the inorganic pigment is a synthetic particulate silica.

4. The ink-jet recording medium of claim 1, wherein the adhesive is an adhesive selected from the group consisting of polyvinyl alcohol, oxidized starch, etherified starch, melamine resin and urea resin.

5. The ink-jet recording medium of claim 1, wherein the adhesive is casein.

6. The ink-jet recording medium of claim 1, wherein the adhesive is gelatin.

7. The ink-jet recording medium of claim 1, wherein the adhesive is soybean protein.

8. The ink-jet recording medium of claim 1, wherein the adhesive is silanol-modified polyvinyl alcohol.

9. The ink-jet recording medium of claim 1, wherein the adhesive is maleic anhydride resin.

10. The ink-jet recording medium of claim 1, wherein the adhesive is a conjugated diene copolymer selected from the group consisting of styrene-butadiene copolymer and methyl methacrylate-butadiene copolymer.

11. The ink-jet recording medium of claim 1, wherein the adhesive is an acrylic polymer.

12. The ink-jet recording medium of claim 1, wherein said ink-receiving layer further comprises a vinyl polymer as an adhesive.

13. The ink-jet recording medium of claim 1, wherein said support comprises paper having a maximum Stockight sizing degree of 40 seconds.

14. The ink-jet recording medium of claim 1, wherein the medium has been subjected to finishing by use of a super calender, a gloss calender and/or passed through a pressure roll nip.

15. A process for ink-jet printing, comprising i) placing an ink-jet recording medium in cooperating relationship with an ink-jet printer;

ii) printing an image on said recording medium using said printer;

wherein said ink-jet recording medium comprises a non-heat sensitive support containing from 5 to 30 parts by weight of filler per 100 parts by weight of support and having a Stöckight sizing degree of 5 seconds or more; and an ink receiving layer containing (1) at least one compound having one triple bond in the molecule and selected from the group consisting of acetylene glycol, ethylene oxide addition product of acetylene glycol and acetylene alcohol; (2) an adhesive and (3) an inorganic pigment;

wherein said compound is at least coated on said support;

and wherein said adhesive is at least one member selected from the group consisting of polyvinyl alcohol, oxidized starch, etherified starch, carboxymethyl cellulose, hydroxyethyl cellulose, casin, gelatin, soybean protein, silanol-modified polyvinyl alcohol, maleic anhydride resin, conjugated diene copolymer, acrylic polymer, polyurethane resin, unsaturated polyester resin, vinyl chloride resin-vinyl acetate copolymer, polyvinyl butyral, alkyl resin, melamine resin and urea resin.

* * * * *